US008028524B2

(12) United States Patent
Middlebrook et al.

(10) Patent No.: US 8,028,524 B2
(45) Date of Patent: Oct. 4, 2011

(54) SUPERCHARGER WITH OIL SLINGER AND BAFFLES

(75) Inventors: James K. Middlebrook, Channel Islands, CA (US); Michael W. Reagan, Channel Islands, CA (US); Matthew L. Shemenski, Channel Islands, CA (US)

(73) Assignee: Vortech Engineering, Inc., Channel Islands, CA (US)

( * ) Notice: Subject to any disclaimer, the term of this patent is extended or adjusted under 35 U.S.C. 154(b) by 522 days.

(21) Appl. No.: 12/167,940

(22) Filed: Jul. 3, 2008

(65) Prior Publication Data

US 2010/0000498 A1 Jan. 7, 2010

(51) Int. Cl.

| | |
|---|---|
| ***F02B 33/44*** | (2006.01) |
| ***F02B 39/02*** | (2006.01) |
| ***F01D 25/18*** | (2006.01) |
| ***F04D 29/06*** | (2006.01) |
| ***F01M 9/06*** | (2006.01) |

(52) U.S. Cl. ..... 60/605.3; 123/559.1; 417/366; 417/372; 417/423.13; 415/110; 415/111; 415/175; 184/11.1; 184/13.1

(58) Field of Classification Search ..... 60/605.3; 123/559.1; 417/366, 372, 423.13; 184/11.1, 184/13.1, 6.12, 6.13; 415/110, 111, 175
See application file for complete search history.

(56) References Cited

U.S. PATENT DOCUMENTS

| | | | | | |
|---|---|---|---|---|---|
| 1,974,974 | A * | 9/1934 | Puffer | ..... | 184/13.1 |
| 2,264,847 | A * | 12/1941 | Johnson | ..... | 417/415 |
| 3,778,194 | A * | 12/1973 | Miller et al. | ..... | 415/175 |
| 4,171,137 | A * | 10/1979 | Aizu et al. | ..... | 415/175 |
| 4,712,442 | A * | 12/1987 | Baika et al. | ..... | 184/6.12 |
| 5,443,054 | A * | 8/1995 | Tateno et al. | ..... | 123/559.1 |
| 6,086,343 | A * | 7/2000 | Sun et al. | ..... | 184/6.13 |
| 6,439,208 | B1 * | 8/2002 | Jones | ..... | 123/559.1 |
| 6,516,789 | B1 * | 2/2003 | Jones | ..... | 123/559.1 |
| 7,654,251 | B2 * | 2/2010 | Jones et al. | ..... | 123/559.1 |
| 7,669,586 | B2 * | 3/2010 | Prior | ..... | 123/559.1 |
| 2002/0141862 | A1 * | 10/2002 | McEwen | ..... | 415/111 |
| 2003/0159888 | A1 * | 8/2003 | Burkholder | ..... | 184/11.1 |

* cited by examiner

*Primary Examiner* — Mary A Davis
(74) *Attorney, Agent, or Firm* — Holland & Knight LLP; Richard E. Lyon, Jr.

(57) ABSTRACT

A supercharger for an internal combustion engine having an internal reservoir adapted to receive a supply of lubricating oil. An oil slinger is mounted on the impeller shaft for rotation therewith that extends into the reservoir for collecting and slinging lubricating oil onto the supercharger bearings, shafts and the drive and impeller gears. A baffle assembly is carried by the interior of the supercharger housing for controlling the volume and flow of lubricating oil onto said gears and bearings and directing oil flow therefrom back into said reservoir to prevent excessive lubrication buildup on the gears and the deleterious effects that result therefrom.

47 Claims, 10 Drawing Sheets

SUPERCHARGER WITH OIL SLINGER AND BAFFLES

BACKGROUND OF THE INVENTION

The present invention relates to superchargers for internal combustion engines and more particularly, to an improved, low cost and compact self-lubricating centrifugal supercharger employing a rotary driven oil slinger that avoids excessive lubrication disposition onto and around the shafts, gears and associated bearings and excessive lubrication build-up on the rapidly rotating gears that cause power losses and an undesirable rise in temperature of the lubrication oil.

The use of oil slingers as an economical means of lubricating intermeshing gears and associated bearings has been well known for many years. See, for example, *Gear Handbook*, published in 1962 by McGraw-Hill Book Company. A gear or disc is mounted on a rotating shaft, typically a drive shaft, so as to pass a lower portion of the gear or disc through an internal reservoir of lubrication oil. As the rotating gear or disc passes through the reservoir of lubrication oil, it lubricates the intermeshing gears and associated bearing assemblies by slinging a mist of oil from the reservoir onto the gears and bearings. Oil slingers have been used in a variety of high speed applications, including superchargers. See, for example, U.S. Pat. No. 1,974,974 (Puffer), U.S. Pat. No. 3,734,637 (Beck) and U.S. Pat. No. 4,090,588 (Willover). While such internal lubricating systems have several cost advantages over external systems, it has been found that during operation, these rapidly rotating oil slingers tend to throw an excessive volume of lubricating oil onto the gears and bearing assemblies inside the transmission case. Also, the rotating gears will collect lubricating oil on the perimeter of their toothed surfaces creating, in effect, rolling "doughnuts" of lubricant. Oil splashing onto the gears from the reservoir exacerbates the situation. The result of the entrained oil carried by the meshing gears in a supercharger is a significant power loss due to the shearing of the viscous lubricant film and resistance to rotation created by the large volume of lubricating oil engaging the mechanical components. Also, a significant rise in the temperature of the oil within the internal reservoir results which can ultimately lead to product failure. The supercharger of the present invention retains the simplified low cost solution for effecting lubrication of the gears and bearing assemblies provided by a rotating oil slinger, while effectively and efficiently controlling the volume and flow of lubricating oil so as to prevent the above-described power drain and associated temperature rise in the lubricating oil that was heretofore inherent in such lubricating systems.

SUMMARY OF THE PRESENT INVENTION

Briefly, the present invention, in a preferred embodiment, comprises a supercharger having an internal lubrication reservoir, a drive gear mounted on a drive shaft above the reservoir, an impeller, an impeller gear mounted on an impeller shaft below the drive gear that engages the drive gear to effect stepped up rotation of said impeller in response to rotation of the drive shaft, bearing assemblies, an oil slinger mounted on the impeller shaft adjacent to the impeller gear for rotation therewith such that the oil slinger projects radially beyond the impeller gear and at least a lower portion thereof is submerged within the lubrication fluid in the reservoir and a baffle assembly proximate the gears and oil slinger for controlling the flow of lubricating oil. The baffle assembly limits the amount of oil directed by the slinger onto the gears and associated bearing assemblies, limits oil splash onto the gears from the oil reservoir, strips excess oil from the drive and impeller gears that is entrained on the perimeter thereof during rotation of the gears and directs oil back to the lubrication reservoir whereby the aforesaid power losses and temperature elevation of the lubricant are substantially reduced while maintaining adequate lubrication of the gears and associated bearings. A lightweight, foaming resistant oil is preferably employed in the preferred embodiment of the present invention.

DESCRIPTION OF THE PREFERRED EMBODIMENT

Figure 2:
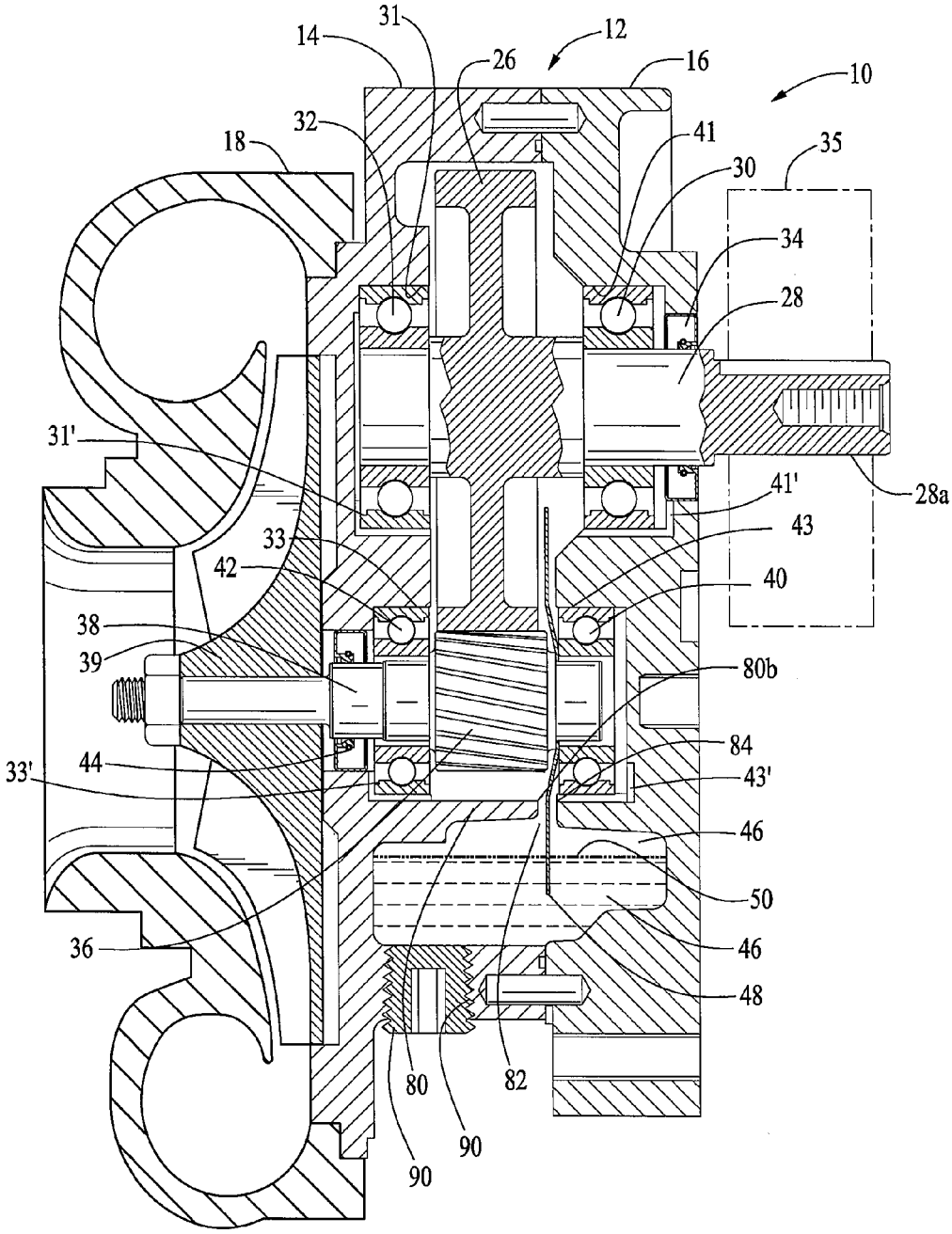
FIG. 2 is a sectional side view taken along the line 2-2 of FIG. 1 with the teeth on the impeller gear being shown for clarification purposes.

A preferred embodiment of the supercharger 10 of the present invention is a centrifugal supercharger of the type mechanically driven by an associated engine such as an internal combustion engine in an automobile. Such a supercharger is disclosed in Applicant's U.S. Pat. No. 5,224,459, the teachings of which are incorporated by reference as though fully set forth herein. In its preferred configuration, supercharger 10 of the present invention includes a housing 12 comprised of a gear case 14 and cover 16 and a volute 18, all of which are preferably aluminum castings. The volute is mounted onto the back plate 20 of the gear casing and the cover 16 is bolted onto the gear case 14 through a plurality of aligned apertures 22 and 24 in the case and cover. The large drive gear 26 is mounted on a drive shaft 28 which is supported by ball bearing assemblies 30 and 32 mounted in the aligned cylindrical bearing bores 31 and 41 in the gear case and cover, respectively. The drive shaft projects outwardly from the supercharger housing 12 through an oil seal 34 in the housing cover 16 as seen in FIG. 2. A drive pulley 35 is mounted on the extended portion 28A of the drive shaft for operable engagement with a drive belt (also not shown) driven by an external engine. A smaller driven impeller gear 36 is mounted on the impeller shaft 38 which is supported by ball bearing assemblies 40 and 42 mounted in the aligned cylindrical bearing bores 33 and 43 in the gear case and cover, respectively. The impeller gear 36 operatively meshes with the drive gear 26. A high speed lip seal 44 or other suitable mechanical seal is concentrically positioned around the impeller shaft 38. Other types of suitable seals, including a spring-biased carbon-ring face seal, also could be utilized. The impeller shaft carries the impeller 39 which turns in a chamber in the volute 18. The drive and impeller gears 26 and 36 preferably feature helical teeth and, by way of example, form a gear ratio of 3.6:1. The relationship between the crankshaft pulley and the pulley on the drive shaft 28 also can be a gear ratio, such as about 2:1, providing an overall 7.2:1 step-up between the engine crankshaft and the supercharger impeller. These ratios are by way of example only and can be varied without affecting the scope of the present invention.

Figure 3:
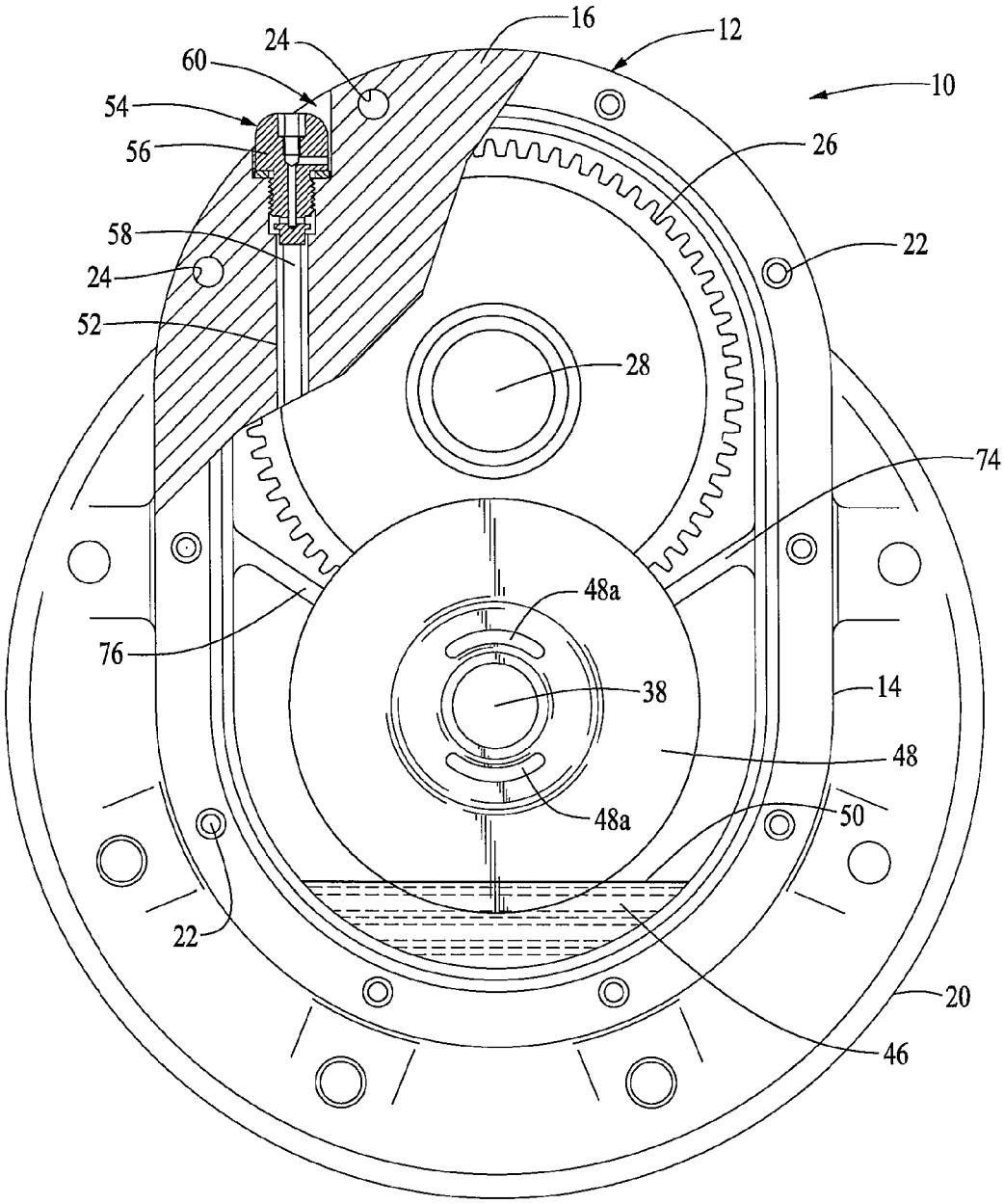
FIG. 3 is a frontal plan view of a portion of the supercharger of FIG. 1 with a portion of the cover removed to reveal the interior components thereof.

The housing cover 16 and gear case 14 cooperatively define an internal lubricant reservoir 46 (see FIG. 2) disposed below the impeller shaft 38 and gear 36. An oil slinger 48, preferably defined by an annular dished disc, is centrally mounted on the impeller shaft 38 adjacent the impeller gear 36, as is also seen in FIG. 2. The oil slinger disc is sized so as to project radially beyond the impeller gear and into the internal lubricant reservoir 46 such that a lower portion of the oil slinger extends about 0.5 in. below the oil level 50 in the reservoir. The reservoir 46 is partially filled with oil lubricant, preferably a lightweight, non-foaming synthetic oil, through a fill channel 52 formed in the housing cover 16. Channel 52 is generally closed by a dipstick assembly 54 threadably engaging the upper inlet end 60 thereof. The dipstick assembly 54 is comprised of a vented breather plug 56 and a dipstick rod 58 that depends from plug 56 and is preferably formed of a suitable plastic material but may be formed of metal as well (see FIG. 3).

Figure 4:
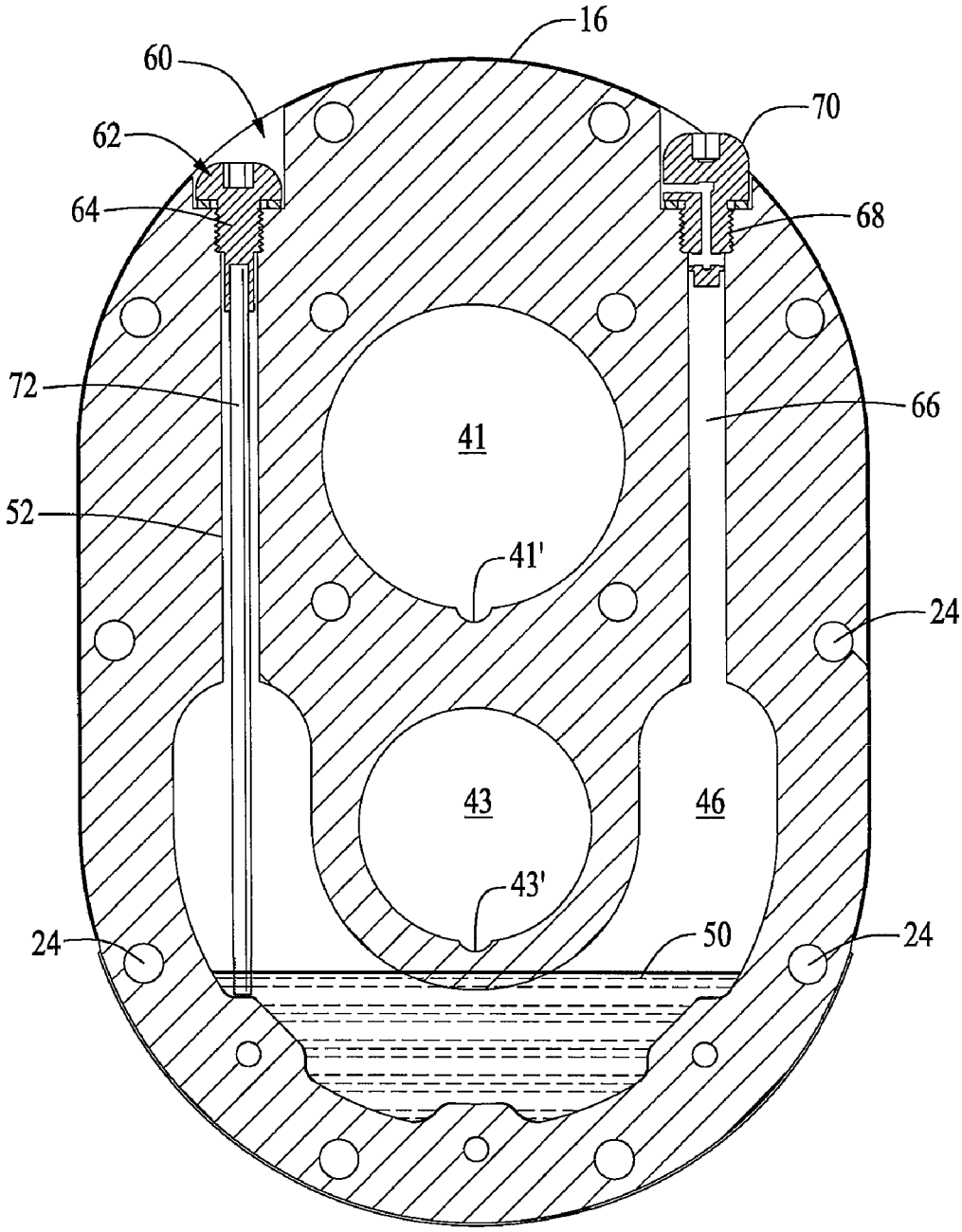
FIG. 4 is a sectional view of an alternate embodiment of the cover.

In an alternate embodiment of the cover 16 (see FIG. 4), the dipstick assembly 54 is replaced with a dipstick assembly 62 having a non-vented plug 64. A second channel 66 communicating the reservoir 46 with the atmosphere is provided on the opposite side of the supercharger 10 from fill channel 52. Channel 66 is provided with a threaded inlet 68 to threadably engage a vented breather plug 70. The depending dipstick rod 72 in assembly 62, like dipstick rod 58 in assembly 54, is preferably formed of a plastic material for measuring the oil level within reservoir 46. By separating the vented breather plug from the dipstick assembly, any oil leakage through a wicking effect of the oil up the dipstick rod is prevented.

Figure 5:
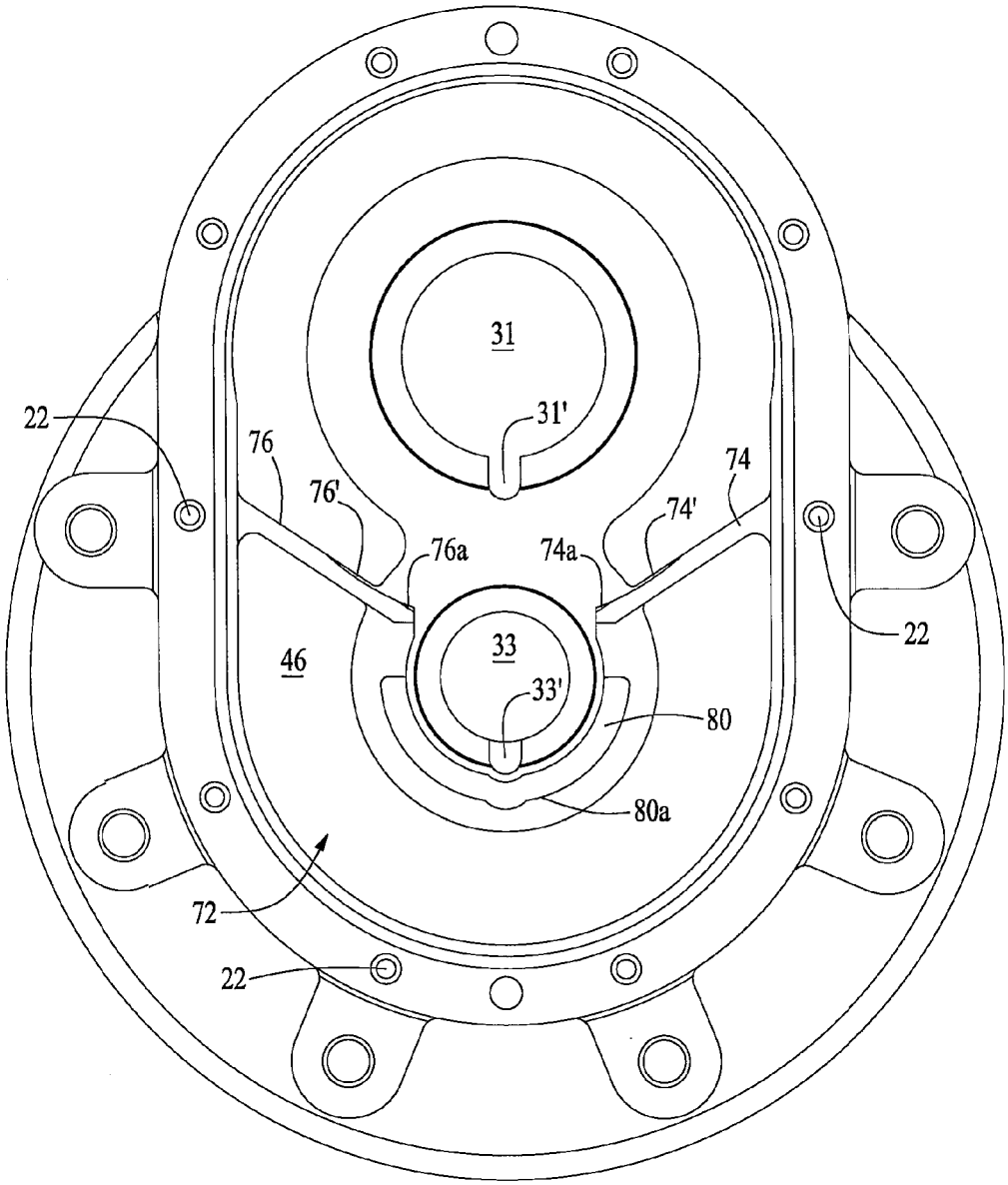
FIG. 5 is a frontal plan view of a portion of the supercharger of FIG. 1 illustrating preferred embodiments of the supercharger gear casing and oil slinger baffle assembly of the present invention.
Figure 6:
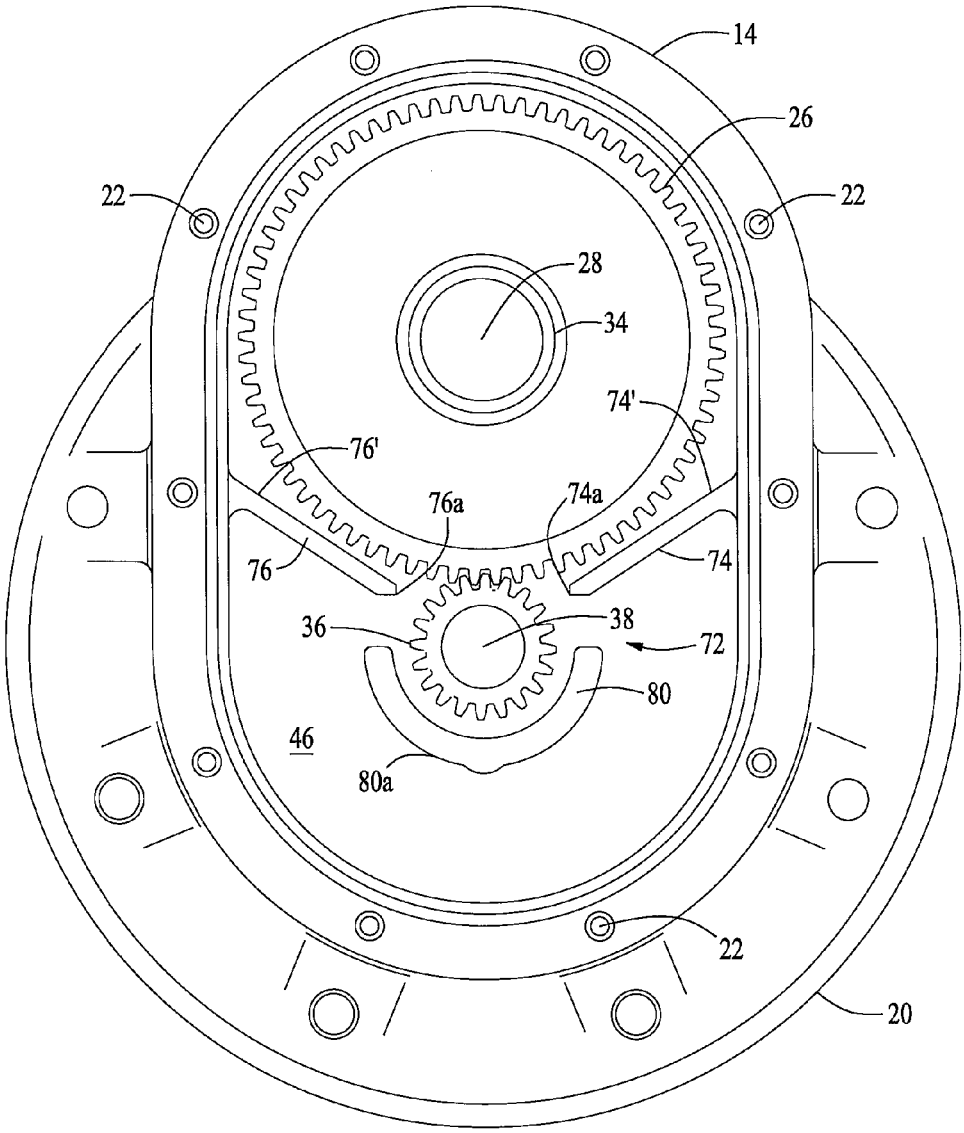
FIG. 6 is the frontal plan view of FIG. 3 with the cover portion and slinger disc removed to illustrate the relative positioning of the gears with respect to the baffle assembly.
Figure 7:
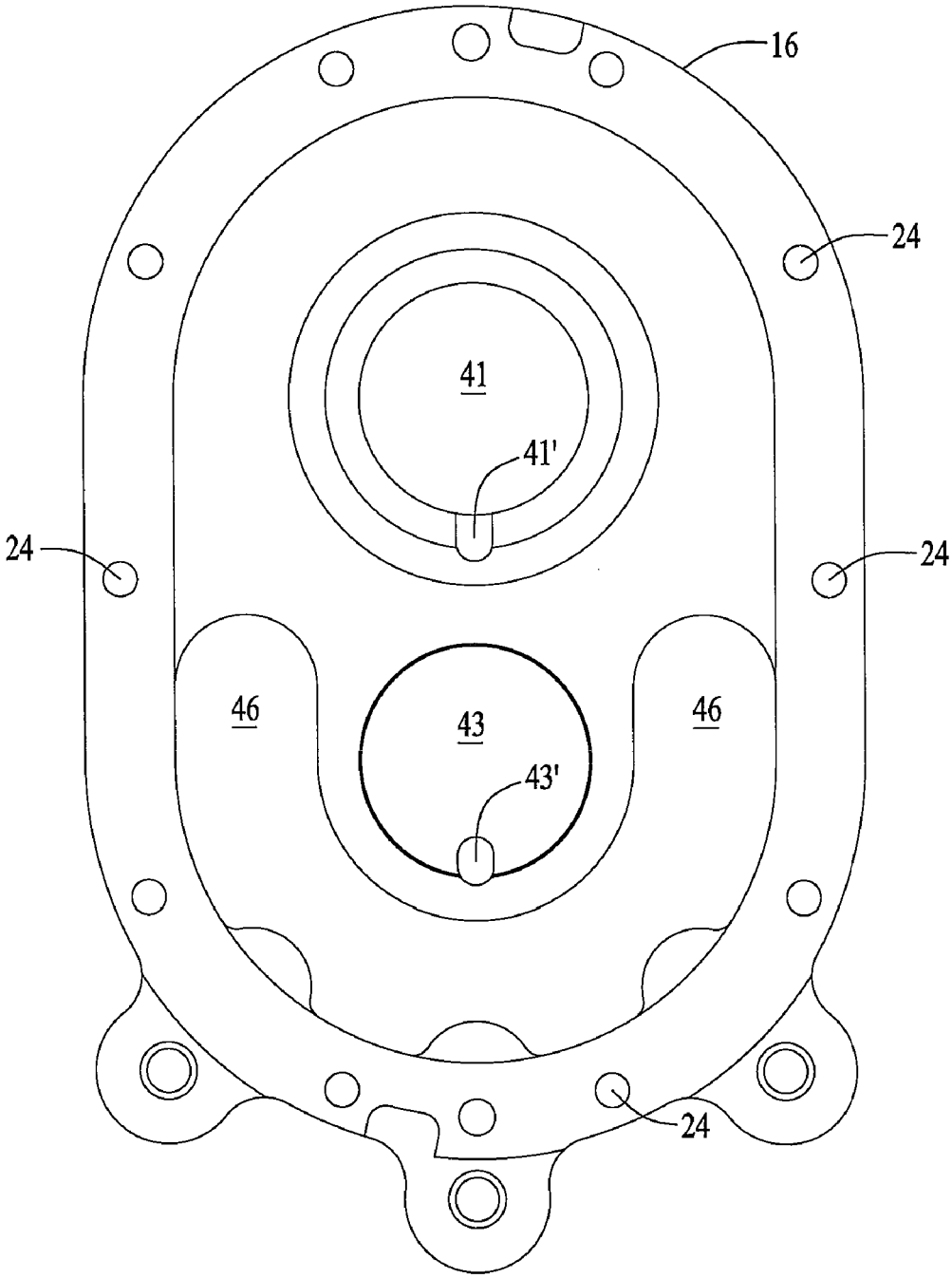
FIG. 7 is a frontal plan view of a preferred embodiment of the interior of the supercharger housing cover.

In use, the oil slinger disc 48 carried by the impeller shaft 38 is rotated through the lubricating oil in reservoir 46 at speeds of 12,960 rpm with an engine speed of 2000 rpm and over 43,000 rpm at an engine speed of 6000 rpm (using the gear ratio channels provided above). As the disc 48 passes through the lubricant oil in the reservoir 46, it collects and "slings" a mist of lubricating oil onto the drive and impeller gears and associated bearing assemblies. To limit and control the "flow" of the lubricating oil, the interior of the gear case 14 is provided with a baffle assembly 72 (see FIG. 5). The baffle assembly comprises a pair of oil impervious anti-windage or barrier walls 74 and 76 that extend at downward inclinations from the interior wall surface of the gear case and terminate in end portions 74A and 76A proximate upper lateral portions of a cylindrical bearing bore 33. The baffle assembly 72 also includes a generally semi-circular, oil impervious, low barrier wall 80, which preferably is disposed about the lower half of bore 33. Barrier walls 74, 76 and 80 are preferably integrally cast with the gear case and are positioned relative to the diameters of the drive and impeller gears of supercharger 10 such that the inclined walls 74 and 76 are spaced approximately 1/16 in. from the perimeter surface of the drive gear 26 and the lower barrier wall 80 is spaced approximately 1/8 in. from the lower perimeter portion of the impeller gear 38 (see FIG. 6).

Figure 10A:
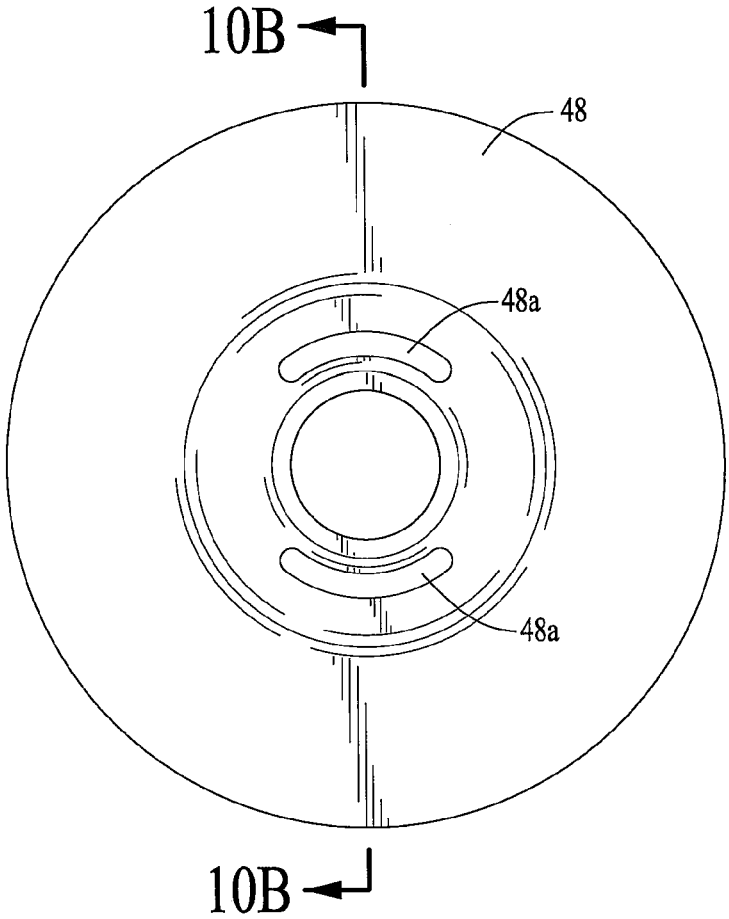
FIG. 10A is a frontal view of a preferred configuration of the slinger disc of the present invention.
Figure 10B:
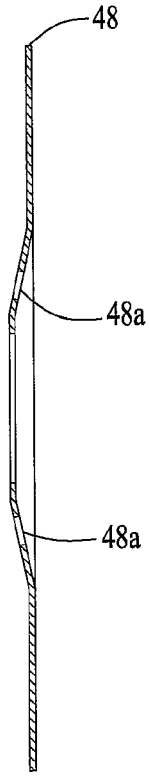
FIG. 10B is a sectional view taken along the line 10B-10B in FIG. 10A.

As the lower portion of the rapidly rotating disc 48 passes through the lubricating oil in reservoir 46, oil is entrained onto a perimeter portion of the disc, similar to the previously discussed oil entrainment on a toothed gear, but to a somewhat lesser extent, and, as described above with respect to a gear, tends to form an expanding "doughnut" of lubricant. Unrestrained, this entrained oil on the slinger disc 48 would be thrown or slung outwardly, predominantly upwardly, as a result of the centrifugal force acting thereon, significantly increasing the volumetric flow of oil onto the gears, shafts and bearings and giving rise to the power loss and temperature elevations noted earlier herein. With the present invention, however, the underside 80A of the lower curvilinear barrier wall 80 functions as an anti-windage device, preventing a substantial amount of the airborne lubricant created by the rapidly rotating disc from reaching the impeller and drive gears and also substantially reducing the back-splashing from the lubricant reservoir 46 onto the gears. The lubricating oil that is slung upwardly by the slinger disc 48, collects on the drive gear 26, drive shaft 28 and associated bearing assemblies 30 and 32. The oil then flows downwardly under the force of gravity onto and along the upper surfaces 74' and 76' of the inclined barrier walls 74 and 76 and onto the impeller gear 36 and shaft 38. The rotating impeller gear will drive oil outwardly onto bearing assembly 42 in the gear case 14 and onto the bearing assembly 40 in the cover 16. To enable the dispersed lubricating oil, to reach the bearing assembly 40 disposed about the impeller shaft in the housing cover, a pair of opposed apertures, 48A preferably kidney-shaped, are provided in the side of the slinger disc 48 as shown in FIG. 10B. Other aperture configurations in the disc could, of course, be employed. The lubricating oil will continue to flow downwardly and back into reservoir 46, passing about the lower barrier wall 80 and through the gap 82 between the end surface 80B of the lower barrier wall 80 and the opposed surface 84 on the interior of the supercharger cover 16. Downwardly inclined flow channels 31', 33', 41' and 43' are provided in the bearing bores 31, 33, 41 and 43 respectively to facilitate oil drainage from the bores and prevent a build-up of lubrication oil behind the bearing assemblies.

As lubricating oil builds up on the perimeter portion of the rotating drive gear, the upper surfaces 74' and 76' of the inclined barrier walls, located only about 1/16 of an inch from the perimeter of the toothed drive gear 26, will strip entrained oil off the gear teeth and adjacent perimeter portions of the drive gear and direct the stripped oil, under the force of gravity, back into the reservoir 46. The stripping of the oil from drive gear 26 occurs primarily at the extended end portion 74A or 76A of barrier wall 74 or 76, depending on the rotational direction of the drive gear. If the drive gear is rotating in a clockwise direction, as seen from looking at FIG. 6, the striping would primarily occur at the end portion 76A of barrier wall 76. If the drive gear were rotating counter-clockwise, oil stripping would primarily occur at the extended end portion 74A of barrier wall 74. Similarly, the interior surface of the lower curvilinear barrier wall 80 will strip lubrication oil on the teeth and adjacent perimeter portion of the impeller gear 36 and the stripped oil will also flow back down into the lubrication reservoir 46.

By so limiting the "volumetric "flow" slinging of the lubricating oil onto the drive gear and surrounding area stripping excess entrained oil from the perimeter portions of the drive and impeller gears and directing the stripped oil back to the lubrication reservoir, the loss of power that typically results from the use of an oil slinger and the accompanying undesirable rise in temperature of the oil in reservoir 46 are prevented, enhancing the efficiency and durability of the supercharger, while continuing to provide adequate lubrication of the supercharger component.

Figure 1:
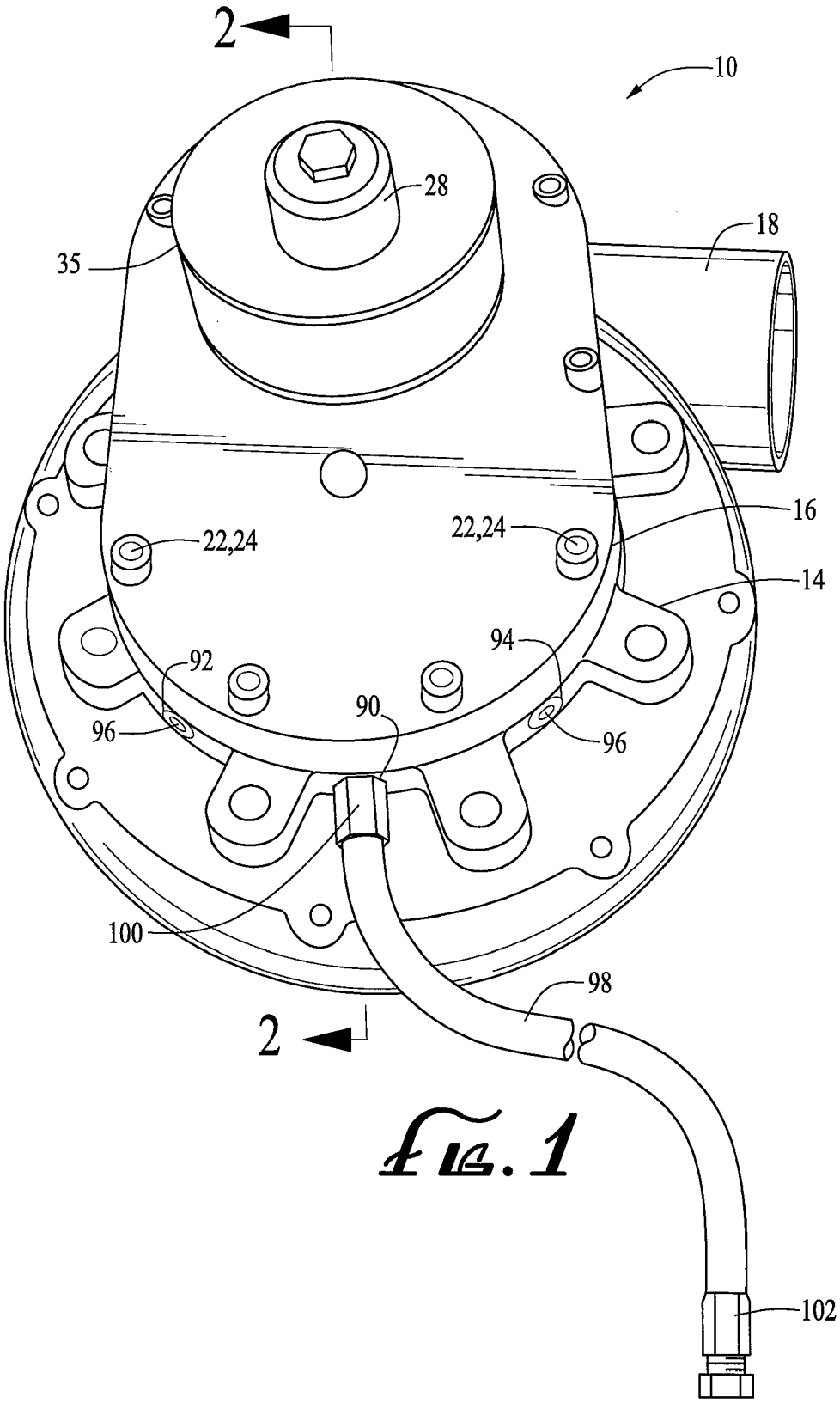
FIG. 1 is a perspective view of a preferred embodiment of a supercharger embodying the present invention.

The gear case 14 of supercharger 10 is preferably provided with three spaced threaded ports 90, 92 and 94 in the underside thereof communicating with the oil reservoir 46. Each of the three ports is generally initially sealed with a threaded closure plug 96. Depending upon the particular orientation of the supercharger in the vehicle, the plug that is in the lowermost position of the three plugs is removed and replaced with a drain hose assembly for changing the oil in the reservoir 46 without having to remove the supercharger from the vehicle. In FIG. 1, hose 98 is connected to port 90 by means of a suitable threaded connector 100 and is provided with a valve assembly 102 or a removable plug at its extended end. When installed, the hose can be "snaked" down to a low point below the supercharger mounting location. The hose is then clamped or otherwise secured in place. Upon opening the valve assembly 102, the oil can be easily drained from the supercharger, obviating the need to remove the supercharger from the vehicle in order to change the lubrication oil as is typically the case with existing superchargers having internal lubrication reservoirs. As the orientation of the supercharger 10 with respect to the vertical will vary in different vehicles and other applications, the use of a plurality of available spaced ports allows for the drain hose to be communicated with a port at or adjacent the lowest point of the reservoir regardless of the angular orientation of the supercharger within the vehicle.

Figure 8:
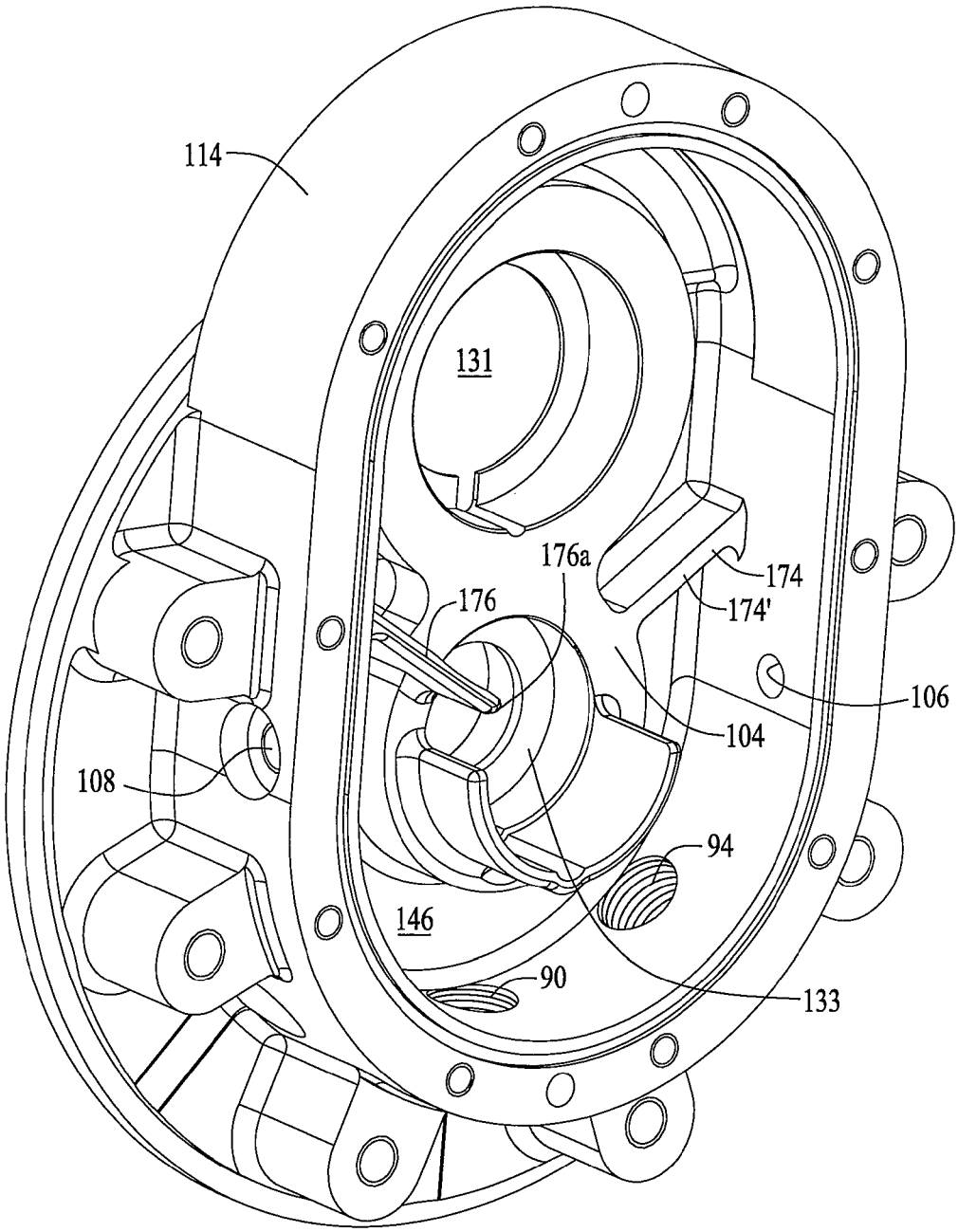
FIG. 8 is a perspective view of a gear casing illustrating an alternate embodiment of the oil slinger baffle assembly of the present invention.
Figure 9:
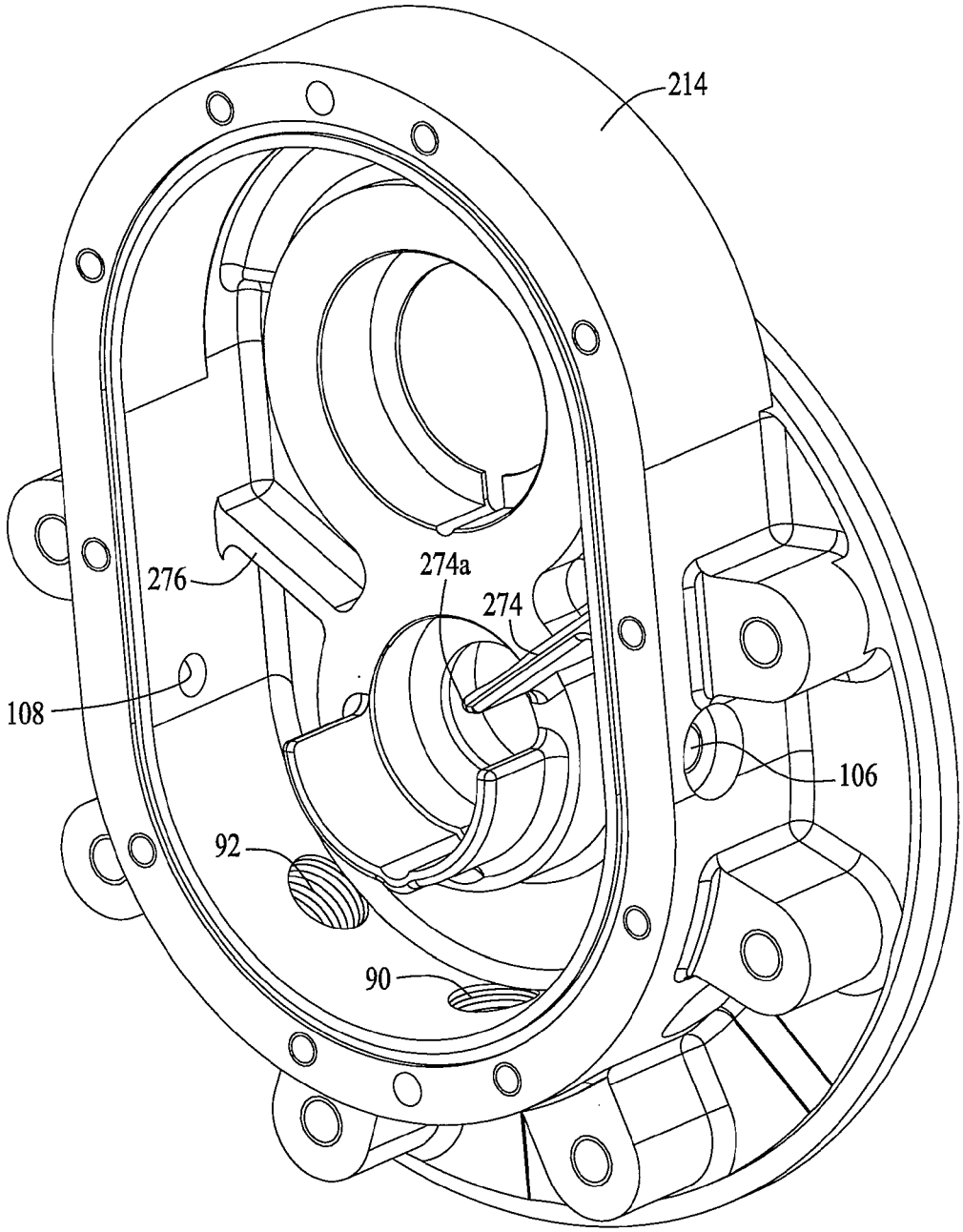
FIG. 9 is a perspective view of a gear casing illustrating a second alternate embodiment of the oil slinger baffle assembly of the present invention.

The threaded ports 90, 92 and 94 also can be used to accommodate an external oil lubrication system. In applications wherein the engine to which the supercharger is connected is operated at high load or full throttle over extended periods of time, as for example, in a watercraft, an external lubrication system may be necessary. Prolonged high load or full throttle operation can require a greater volumetric oil flow through the supercharger than can be readily provided by an internal system. In a preferred embodiment of the supercharger, two side ports 106 and 108 can be provided in the housing that communicate with the lubrication reservoir. Such ports are illustrated in FIGS. 8 and 9. The lubricating oil would flow to the reservoir through a hose (not shown) communicating with either port 106 or 108 and from the reservoir and back to the engine lubrication circuit or other external lubrication system through the lowermost of ports 90, 92 and 94. The selection of ports 106 or 108 and 90, 92 or 94 again depends on the angular orientation of the supercharger in the vehicle or other application, and the rotational direction of the drive shaft 28. Note that both side ports 106 and 108 are laterally aligned with the gap between the upper and lower barrier walls so that the lubricating oil can be directed at the interface of the intermeshing gear teeth on the drive and pinion gears. Port 106 or 108 is chosen such that the lubrication oil is introduced into the rotating direction of the intermeshing gear teeth and entrained thereon. Also note that in the embodiments of FIGS. 8 and 9, only one such gap exists as one of the upper baffle walls is removed, as will be described. However, in the previously discussed baffle assembly 72, both of the side ports are aligned with the gaps between the upper and lower baffle walls.

With an external lubrication system, the oil slinger would continue to operate as previously described as the lubrication oil was continuously replenished by the external system. However, in such applications, the baffle assembly will continue to control the oil flow through the supercharger. While heat build-up in the lubrication oil would not present as much of a problem in such applications as the oil is constantly "changed," the oil entrainment phenomenon remains. The baffle assembly will continue to function as previously described, controlling the flow and preventing the power loss that would otherwise occur as a result of the entrainment phenomenon. In the majority of applications, however, where continuous high load or full throttle operation is not encountered, e.g. automobiles, the oil slinger 48 and baffle assembly 72 provide excellent lubrication of the supercharger components without the need for external oil. The addition of the extra ports for use with an external lubrication system enhances the flexibility of the supercharger 10.

While the baffle assembly 72 discussed above and illustrated in FIG. 6 accommodates both clockwise and counter-clockwise rotation of the gears, FIGS. 8 and 9 illustrate modified gear cases 114 and 214 particularly configured for a clockwise (FIG. 8) or counter-clockwise (FIG. 9) drive gear rotation as viewed from the front of the respective figures. As seen in FIG. 8, the upper portion of the upper barrier wall 174 has been removed such that the upper surface 174' of the wall is coplanar with the flat casing surfaces 104 extending about the vertically aligned bearing bores 131 and 133 that house the bearing assemblies (not shown in FIG. 8) that support the drive and impeller shafts in the gear case. Such a configuration better accommodates drainage of the lubrication oil back to the reservoir 146 and, with a clockwise rotation of the drive gear, the stripping of the oil therefrom primarily occurs at the extended end portion 176A of barrier wall 176. FIG. 9 illustrates a corresponding modification of upper barrier wall 276 for a counter-clockwise rotation of the supercharger drive gear where stripping of the oil would primarily occur at the end portion 274A of barrier wall 274. In both the embodiments of FIGS. 8 and 9, the drive gear rotates in a direction so as to pass upwardly along the single inclined barrier wall 174 or 274 such that the end portion of the wall will more effectively strip oil from the drive gear.

Although the present invention has been described by way of exemplary embodiments, it should be understood that various changes and modifications may be made in carrying out the present invention without departing from the spirit and scope thereof. Insofar as these changes and modifications are within the purview of the appended claims, they are to be considered as part of the present invention.

We claim:

1. A supercharger for an internal combustion engine comprising a housing, a drive shaft, a drive gear mounted on the drive shaft, an impeller shaft disposed below said drive gear, an impeller gear mounted on the impeller shaft and engaging said drive gear, a plurality of bearing assemblies comprising bearings supporting said drive and impeller shafts, a fluid reservoir within said housing for holding a supply of lubricating oil therein, an oil slinger mounted on said impeller shaft and extending into said reservoir for collecting and slinging lubricating oil onto said bearings, said drive and impeller shafts and said drive and impeller gears, and a baffle assembly disposed within said housing comprising a plurality of upper baffles and at least one lower baffle, said upper baffles defining inclined walls extending at downward inclinations from opposed portions of said housing proximate lower perimeter portions of said drive gear and said lower baffle defining a curvilinear wall proximate a lower perimeter portion of said impeller gear, said inclined and curvilinear walls stripping lubrication oil from said drive and impeller gears during rotation thereof and controlling the volume and flow of lubricating oil onto said drive and impeller gears, said drive and impeller shafts and said bearings and directing oil flow therefrom back into said reservoir.

2. The supercharger of claim 1 wherein said oil slinger comprises a disc, said disc being substantially adjacent to said impeller gear and one of said bearing assemblies and having at least one aperture therein for allowing lubricating oil to pass therethrough to effect lubrication of said one bearing assembly.

3. The supercharger of claim 1 wherein said oil slinger comprises a disc.

4. The supercharger of claim 1 wherein said oil slinger comprises a disc, said disc being substantially adjacent said impeller gear and one of said bearing assemblies.

5. The supercharger of claim 1 wherein said upper baffles are spaced approximately 1/16 in. from perimeter portions of said drive gear and said lower baffle is spaced approximately 1/8 in. from a lower perimeter portion of the impeller gear.

6. The supercharger of claim 1 wherein said housing defines a gear case and a cover, said baffle assembly being integrally formed with said gear case.

7. The supercharger of claim 1 wherein a lower portion of said housing defines a plurality of arcuately spaced apertures therein communicating with said reservoir, each of said apertures being sealed with a removable plug whereby, depending upon the orientation of the supercharger with respect to a vertical axis, a lowermost of said apertures is defined for use in draining the reservoir.

8. The supercharger of claim 7 including a drain hose communicable with said lowermost of said apertures upon the removal of the plug therefrom.

9. The supercharger of claim 1 wherein said housing defines a channel communicating with said reservoir and including a removable dipstick assembly comprising a vented closure for closing said channel and preventing a pressure buildup within said reservoir and a rod depending from said vented closure into said reservoir for measuring a lubrication oil level within said reservoir.

10. The supercharger of claim 1 wherein said housing defines first and second channels therein communicating with said reservoir and including a vented closure in said first channel preventing a pressure buildup within said reservoir and a removable dipstick assembly sealably closing said second channel for use in measuring a lubrication oil level within said reservoir.

11. The supercharger of claim 1 wherein said housing defines a pair of upper apertures therein and a plurality of arcuately spaced lower apertures therein, said upper and lower apertures communicating with said reservoir, each of said lower apertures being sealed with a removable plug whereby, depending upon the orientation of the supercharger with respect to a vertical axis, a lowermost and two remaining apertures are defined, said lowermost aperture defining a reservoir drainage aperture and one of remaining apertures and one of said upper apertures defining inlet and outlet openings for use with an external lubrication system.

12. The supercharger of claim 11 wherein said oil slinger comprises a disc, said disc being substantially adjacent to said impeller gear and one of said bearing assemblies and having at least one aperture therein for allowing lubricating oil to pass therethrough to effect lubrication of said one bearing assembly.

13. The supercharger of claim 11 wherein said upper baffles are spaced approximately 1/16 in. from perimeter portions of said drive gear and said lower baffle is spaced approximately 1/8 in. from a lower perimeter portion of the impeller gear.

14. In a supercharger for an internal combustion engine having a housing, a drive shaft, a drive gear mounted on the drive shaft, an impeller shaft disposed below said drive gear, an impeller gear mounted on the impeller shaft and engaging said drive gear, a plurality of bearing assemblies comprising bearings supporting the drive and impeller shafts and a fluid reservoir within the housing for holding a supply of lubricating oil, the improvement comprising: an oil slinger mounted on said impeller shaft and extending into said reservoir for collecting and slinging lubricating oil onto said bearings, said drive and impeller shafts and said drive and impeller gears; and a baffle assembly disposed within the housing comprises a pair of upper baffles and at least one lower baffle, said upper baffles defining a pair of inclined walls extending at downward inclinations from opposed portions of said housing proximate lower perimeter portions of said drive gear and said lower baffle defining a curvilinear wall proximate a lower perimeter portion of said impeller gear, said inclined and curvilinear walls stripping lubrication oil from said drive and impeller gears during rotation thereof and control the volume and flow of lubricating oil onto said drive and impeller gears, said drive and impeller shafts and said bearings and directing oil flow therefrom back into said reservoir.

15. The improvement of claim 14 wherein said oil slinger comprises a disc having at least one aperture therein for allowing lubricating oil to pass therethrough to effect lubrication of said one bearing assembly.

16. The improvement of claim 14 wherein said oil slinger comprises a disc, said disc being substantially adjacent to said impeller gear and one of said bearing assemblies.

17. The improvement of claim 14 wherein said oil slinger comprises a disc, said disc being substantially adjacent to said impeller gear and one of said bearing assemblies and having at least one aperture therein for allowing lubricating oil to pass therethrough to effect lubrication of said one bearing assembly.

18. The improvement of claim 14 wherein said upper baffles are spaced approximately 1/16 in. from perimeter portions of said drive gear and said lower baffle is spaced approximately 1/8 in. from a lower perimeter portion of the impeller gear.

19. The improvement of claim 14 wherein a lower portion of said housing defines a plurality of arcuately spaced apertures therein communicating with said reservoir, each of said apertures being sealed with a removable plug whereby, depending upon the orientation of the supercharger with respect to a vertical axis, a lowermost of said apertures is defined for use in draining the reservoir.

20. The supercharger of claim 19 including a drain hose communicable with said lowermost of said apertures upon the removal of the plug therefrom.

21. The improvement of claim 14 wherein said housing defines a channel communicating with said reservoir and including a removable dipstick assembly comprising a vented closure for closing said channel and preventing a pressure buildup within said reservoir and a rod depending from said vented closure into said reservoir for measuring a lubrication oil level within said reservoir.

22. The improvement of claim 14 wherein said housing defines first and second channels therein communicating with said reservoir and including a vented closure in said first channel preventing a pressure buildup within said reservoir and a removable dipstick assembly sealably closing said second channel for use in measuring a lubrication oil level within said reservoir.

23. In a supercharger for an internal combustion engine having a housing, a drive shaft, a drive gear mounted on the drive shaft, an impeller shaft disposed below said drive gear, an impeller gear mounted on the impeller shaft and engaging said drive gear, a plurality of bearing assemblies comprising bearings supporting the drive and impeller shafts and a fluid reservoir within the housing for holding a supply of lubricating oil, the improvement comprising: a disc mounted on said impeller shaft and extending into said reservoir for collecting and slinging lubricating oil onto said bearings, said drive and impeller shafts and said drive and impeller gears; and a baffle assembly disposed within said housing for controlling the volume and flow of lubricating oil onto said drive and impeller gears, said drive and impeller shafts and said bearings and directing oil flow therefrom back into said reservoir, said baffle assembly comprising a pair of inclined walls extending at downward inclination from opposed portions of said housing proximate lower perimeter portions of said drive gear and a curvilinear wall portion proximate a lower perimeter portion of said impeller gear, said inclined and curvilinear walls stripping lubrication oil from said drive and impeller gears during rotation thereof.

24. The improvement of claim 23 wherein said housing comprises a gear case and a cover, said inclined walls in said baffle assembly projecting inwardly from said casing toward said cover.

25. In a supercharger for an internal combustion engine having a housing, a drive shaft, a drive gear mounted on the drive shaft, an impeller shaft disposed below said drive gear, an impeller gear mounted on the impeller shaft and engaging said drive gear, a plurality of bearing assemblies comprising bearings supporting the drive and impeller shafts and a fluid reservoir within the housing for holding a supply of lubricating oil, the improvement comprising: a disc mounted on said impeller shaft and extending into said reservoir for collecting and slinging lubricating oil onto said bearings, said drive and impeller shafts and said drive and impeller gears; and a baffle assembly disposed within said housing for controlling the volume and flow of lubricating oil onto said drive and impeller gears, said drive and impeller shafts and said bearings and directing oil flow therefrom back into said reservoir, said baffle assembly comprising an inclined wall extending inwardly at a downward inclination proximate a lower perimeter portion of said drive gear and a curvilinear wall proximate a lower perimeter portion of said impeller gear, said drive gear being adapted for rotation in a direction so as to pass upwardly along said inclined wall, said inclined and curvilinear walls stripping lubrication oil from said drive and impeller gears during rotation thereof.

26. The improvement of claim 25 wherein said housing comprises a gear case and a cover, said inclined walls in said baffle assembly projecting inwardly from said casing toward said cover.

27. The supercharger of claim 26 wherein said oil slinger comprises a disc, said disc being substantially adjacent to said impeller gear and one of said bearing assemblies and having at least one aperture therein for allowing lubricating oil to pass therethrough to effect lubrication of said one bearing assembly.

28. The improvement of claim 25 wherein said inclined wall is spaced approximately 1/16 in. from perimeter portions of said drive gear and said curvilinear wall is spaced approximately 1/8 in. from a lower perimeter portion of the impeller gear.

29. The supercharger of claim 25 wherein said oil slinger comprises a disc, said disc being substantially adjacent to said impeller gear and one of said bearing assemblies and having at least one aperture therein for allowing lubricating oil to pass therethrough to effect lubrication of said one bearing assembly.

30. A supercharger for an internal combustion engine comprising a housing, a drive shaft, a drive gear mounted on the drive shaft, an impeller shaft disposed below said drive gear, an impeller gear mounted on the impeller shaft and engaging said drive gear, a plurality of bearing assemblies comprising bearings supporting said drive and impeller shafts, a fluid reservoir within said housing for holding a supply of lubricating oil therein, an oil slinger mounted on said impeller shaft and extending into said reservoir for collecting and slinging lubricating oil onto said bearings, said drive and impeller shafts and said drive and impeller gears, and a baffle assembly disposed within said housing for controlling the volume and flow of lubricating oil onto said drive and impeller gears, said drive and impeller shafts and said bearings and directing oil flow therefrom back into said reservoir, said baffle assembly comprising an inclined wall extending inwardly at a downward inclination proximate a lower perimeter portion of said drive gear and a curvilinear wall proximate a lower perimeter portion of said impeller gear, said drive gear being adapted for rotation in a direction so as to pass upwardly along said inclined wall, said inclined and curvilinear walls stripping lubrication oil from said drive and impeller gears during rotation thereof.

31. The supercharger of claim 30 wherein said oil slinger comprises a disc, said disc being substantially adjacent to said impeller gear and one of said bearing assemblies and having at least one aperture therein for allowing lubricating oil to pass therethrough to effect lubrication of said one bearing assembly.

32. A supercharger for an internal combustion engine comprising a housing, a drive shaft, a drive gear mounted on the drive shaft, an impeller shaft disposed below said drive gear, an impeller gear mounted on the impeller shaft and engaging said drive gear, a plurality of bearing assemblies comprising bearings supporting said drive and impeller shafts, a fluid reservoir within said housing for holding a supply of lubricating oil therein, an oil slinger being rotatably mounted and extending into said reservoir for collecting and slinging lubricating oil onto said bearings, said drive and impeller shafts and said drive and impeller gears, and a baffle assembly disposed within said housing for controlling the volume and flow of lubricating oil onto said drive and impeller gears, said drive and impeller shafts and said bearings and directing oil flow therefrom back into said reservoir, said baffle assembly comprising an inclined wall extending inwardly at a downward inclination proximate a lower perimeter portion of said drive gear and a curvilinear wall proximate a lower perimeter portion of said impeller gear, said drive gear being adapted for rotation in a direction so as to pass upwardly along said inclined wall, said inclined and curvilinear walls stripping lubrication oil from said drive and impeller gears during rotation thereof.

33. The supercharger of claim 32 wherein said oil slinger comprises a disc.

34. The supercharger of claim 32 wherein said oil slinger comprises a disc having at least one aperture therein for allowing lubricating oil to pass therethrough to effect lubrication of said one bearing assembly.

35. The supercharger of 32 wherein said oil slinger is mounted on said impeller shaft for rotation therewith.

36. In a supercharger for an internal combustion engine having a housing, a drive shaft, a drive gear mounted on the drive shaft, an impeller shaft disposed below said drive gear, an impeller gear mounted on the impeller shaft and engaging said drive gear, a plurality of bearing assemblies comprising bearings supporting the drive and impeller shafts and a fluid reservoir within the housing for holding a supply of lubricating oil, the improvement comprising: an oil slinger being rotatably mounted and extending into said reservoir for collecting and slinging lubricating oil onto said bearings, said drive and impeller shafts and said drive and impeller gears; and a baffle assembly disposed within said housing for controlling the volume and flow of lubricating oil onto said drive and impeller gears, said drive and impeller shafts and said bearings and directing oil flow therefrom back into said reservoir, said baffle assembly comprising an inclined wall extending inwardly at a downward inclination proximate a lower perimeter portion of said drive gear and a curvilinear wall proximate a lower perimeter portion of said impeller gear, said drive gear being adapted for rotation in a direction so as to pass upwardly along said inclined wall, said inclined and curvilinear walls stripping lubrication oil from said drive and impeller gears during rotation thereof.

37. The improvement of claim 36 wherein said oil slinger comprises a disc.

38. The improvement of claim 36 wherein said oil slinger comprises a disc having at least one aperture therein for allowing lubricating oil to pass therethrough to effect lubrication of said one bearing assembly.

39. The improvement of 36 wherein said oil slinger is mounted on said impeller shaft for rotation therewith.

40. A supercharger for an internal combustion engine comprising a housing, a drive shaft, a drive gear mounted on the drive shaft, an impeller shaft disposed below said drive gear, an impeller gear mounted on the impeller shaft and engaging said drive gear, a plurality of bearing assemblies comprising bearings supporting said drive and impeller shafts, a fluid reservoir within said housing for holding a supply of lubricating oil therein, an oil slinger being rotatably mounted and extending into said reservoir for collecting and slinging lubricating oil onto said bearings, said drive and impeller shafts and said drive and impeller gears, and a baffle assembly disposed within the housing and comprising a pair of upper baffles and at least one lower baffle, said upper baffles defining a pair of inclined walls extending at downward inclinations from opposed portions of said housing proximate lower perimeter portions of said drive gear and said lower baffle defining a curvilinear wall proximate a lower perimeter portion of said impeller gear, said inclined and curvilinear walls stripping lubrication oil from said drive and impeller gears during rotation thereof, and control the volume and flow of lubricating oil onto said drive and impeller gears, said drive and impeller shafts and said bearings and directing oil flow therefrom back into said reservoir.

41. The supercharger of claim 40 wherein said oil slinger comprises a disc.

42. The supercharger of claim 40 wherein said oil slinger comprises a disc having at least one aperture therein for allowing lubricating oil to pass therethrough to effect lubrication of said one bearing assembly.

43. The supercharger of 40 wherein said oil slinger is mounted on said impeller shaft for rotation therewith.

44. In a supercharger for an internal combustion engine having a housing, a drive shaft, a drive gear mounted on the drive shaft, an impeller shaft disposed below said drive gear, an impeller gear mounted on the impeller shaft and engaging said drive gear, a plurality of bearing assemblies comprising bearings supporting the drive and impeller shafts and a fluid reservoir within the housing for holding a supply of lubricating oil, the improvement comprising: an oil slinger being rotatably mounted and extending into said reservoir for collecting and slinging lubricating oil onto said bearings, said drive and impeller shafts and said drive and impeller gears; and a baffle assembly disposed within the housing and comprising a pair of upper baffles and at least one lower baffle, said upper baffles defining a pair of inclined walls extending at downward inclinations from opposed portions of said housing proximate lower perimeter portions of said drive gear and said lower baffle defining a curvilinear wall proximate a lower perimeter portion of said impeller gear, said inclined and curvilinear walls stripping lubrication oil from said drive and impeller gears during rotation thereof, and control the volume and flow of lubricating oil onto said drive and impeller gears, said drive and impeller shafts and said bearings and directing oil flow therefrom back into said reservoir.

45. The supercharger of claim 44 wherein said oil slinger comprises a disc.

46. The supercharger of claim 44 wherein said oil slinger comprises a disc having at least one aperture therein for allowing lubricating oil to pass therethrough to effect lubrication of said one bearing assembly.

47. The supercharger of 44 wherein said oil slinger is mounted on said impeller shaft for rotation therewith.

* * * * *